United States Patent [19]

Leistner et al.

[11] Patent Number: 4,474,044

[45] Date of Patent: Oct. 2, 1984

[54] APPARATUS AND PROCESS FOR SUPERPLASTICALLY FORMING METALS

[75] Inventors: Theodore E. Leistner, St. Charles; Michael J. Acker, Sr., St. Johns, both of Mo.

[73] Assignee: McDonnell Douglas Corporation, St. Louis, Mo.

[21] Appl. No.: 414,504

[22] Filed: Sep. 2, 1982

[51] Int. Cl.[3] ..... B21D 22/20; B21D 31/00; B21D 37/16

[52] U.S. Cl. ..... 72/13; 72/37; 72/38; 72/60; 72/342; 72/364; 72/700

[58] Field of Search ..... 72/13, 38, 200, 202, 72/342, 364, 37, 700, 60

[56] References Cited

U.S. PATENT DOCUMENTS

| | | | |
|---|---|---|---|
| 3,264,856 | 8/1966 | Layard | 72/202 |
| 3,344,648 | 10/1967 | Gray | 72/364 |
| 3,345,846 | 10/1967 | Hess | 72/342 X |
| 3,483,721 | 12/1969 | Apple et al. | 72/13 |
| 3,568,490 | 3/1971 | Bohmann | 72/13 X |
| 3,698,219 | 10/1972 | Moore et al. | 72/342 X |
| 3,740,991 | 6/1973 | Walraven et al. | 72/342 |
| 3,974,673 | 8/1976 | Fosness et al. | 72/38 |
| 4,352,280 | 10/1982 | Ghosh | 72/38 |
| 4,354,369 | 10/1982 | Hamilton | 72/38 |
| 4,356,717 | 11/1982 | Okunishi et al. | 72/342 |

*Primary Examiner*—E. Michael Combs
*Attorney, Agent, or Firm*—Gravely, Lieder & Woodruff

[57] ABSTRACT

A flat blank of a metal which becomes superplastic at elevated temperatures is transformed into a part of the desired configuration in an apparatus that is utilized in connection with a hydraulic press, the apparatus having a lower section that is mounted on the press bed and an upper section that moves with the press ram. The lower section includes a forming tool having a contoured surface, the configuration of which corresponds to that which is to be imparted to the blank, and a cooling passage that surrounds the tool. The blank is positioned over the tool and cooling passage of the lower section. The upper section includes a chamber enclosed by walls and a bulkhead, another cooling passage at the lower end of the chamber walls, an infrared emitter within the chamber, and infrared optical sensors that are located outside of the chamber but view the blank through tubes that extend through the bulkhead and the emitter. In use, the press forces the upper and lower sections of the apparatus together so that the blank is captured tightly between the two sections in the region of the cooling passages. Indeed, the upper section at its cooling passage seals against the blank so that the blank forms one wall of the chamber, thus completely isolating the chamber from the surrounding atmosphere. An inert gas is introduced into the chamber and the emitter is energized. The infrared radiation from the emitter raises the temperature of the blank, and when the temperature is detected by the optical sensors, reaches the superplastic region, the pressure of the inert gas within the chamber is increased sufficiently to deform the superplastic portion of the blank against the contoured surface of the tool. The emitter is turned off when the formed part is removed from the lower section, and this may be done manually and without any special protective clothing or equipment.

17 Claims, 6 Drawing Figures

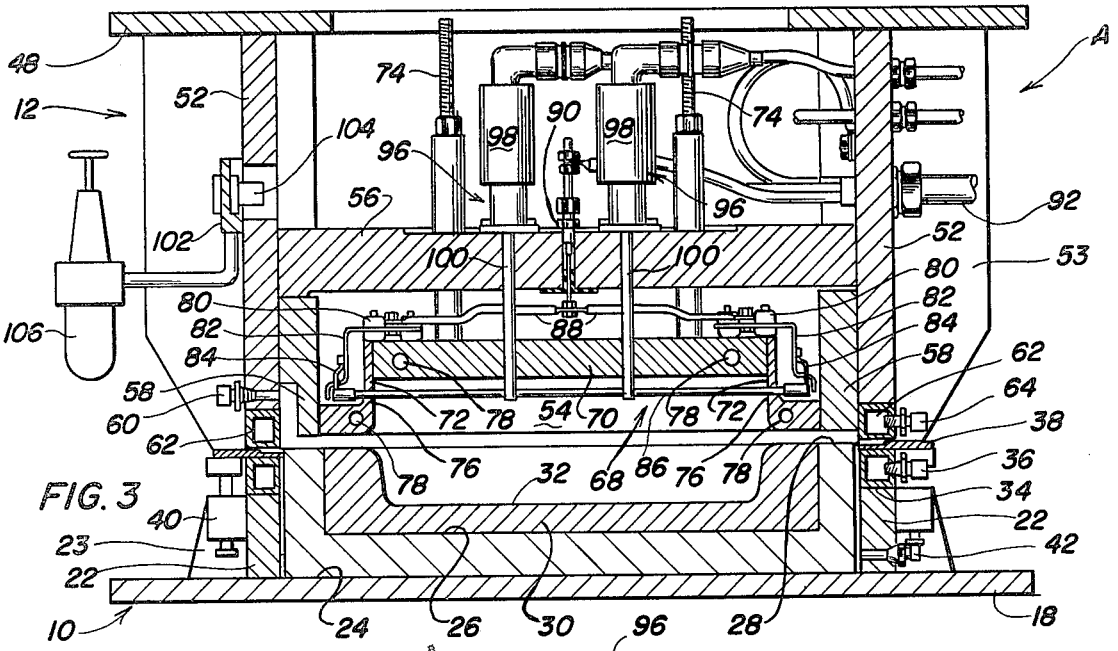
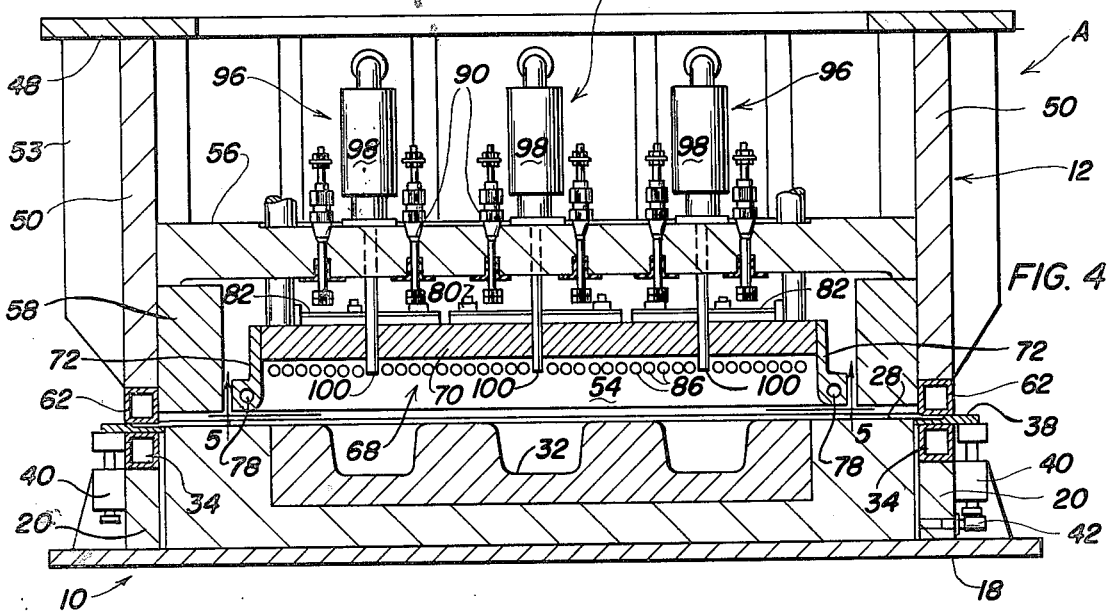
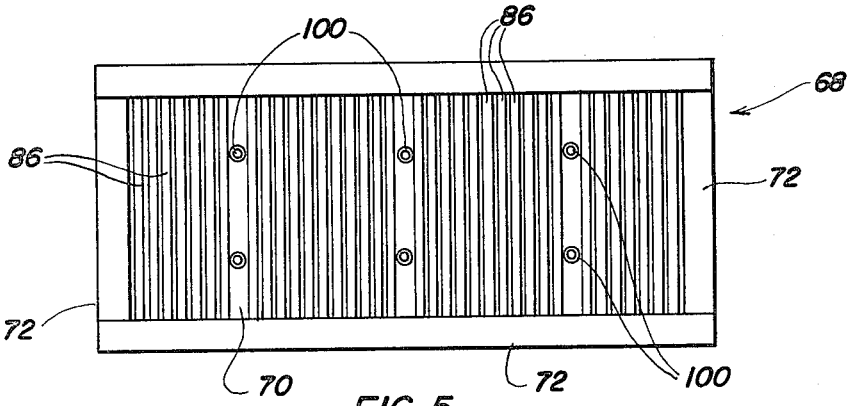
FIG. 5

APPARATUS AND PROCESS FOR SUPERPLASTICALLY FORMING METALS

BACKGROUND OF THE INVENTION

This invention relates in general to the deformation of metals which become superplastic at elevated temperatures and more particularly to an apparatus and process that employs infrared energy to heat such metals.

Titanium, while being quite difficult to work and likewise machine at ambient temperature, becomes superplastic near 1650° F. Thus, it deforms quite easily, that is under relatively little force, once the superplastic characteristics have been acquired. Superplastic deformation has perhaps found its greatest usefulness in connection with making aircraft components from sheet titanium. However, titanium oxidizes quite readily at its superplastic temperature and special precautions must be undertaken to prevent this during the deformation.

Heretofore, sheet titanium has been rendered superplastic and deformed, by placing titanium sheet between steel platens, one of which has a contoured surface corresponding in configuration to that which is to be imparted to the titanium sheet. The platens are heated to about 1650° F. by electrical resistance-type heating elements embedded within them, and at the same time the sheet is subjected to an inert environment, such as one composed of argon gas. The platens, being against the sheet titanium, conduct heat into the titanium and the temperature of the titanium rises until it corresponds to that of the platens. At this time, the pressure of the argon gas on the side of the sheet which is presented away from the contoured surface is elevated sufficiently to deform the titanium sheet against that surface, whereupon the sheet acquires the shape of the surface.

At 1650° F., the platens glow a bright red and cannot be approached without wearing special protective clothing including a face shield. Moreover, special equipment is necessary to insert the flat titanium sheet between the platens and to thereafter remove the formed part. Indeed, the formed part is so hot that it cannot be handled manually, unless by one wearing heavily insulated gloves and then only for a few seconds. The necessity for the protective clothing and special handling equipment derives from the fact that the temperature of the platens remains at about 1650° F., even while the apparatus is being loaded and unloaded, and indeed they must, for the platens have relatively large mass and do not change temperature readily. As a consequence, the heating elements within the platens consume an enormous amount of electrical energy.

SUMMARY OF THE INVENTION

One of the principal objects of the present invention is to provide an apparatus and a process that utilizes infrared energy to superplastically heat metals. Another object is to provide an apparatus of the type stated which does not require special protective clothing for those who operate it. Another object is to provide an apparatus of the type stated that does not require special equipment for loading and unloading manually. A further object is to provide an apparatus and process of the type stated that consumes relatively little energy to elevate the workpieces to the temperature at which they become superplastic. These and other objects and advantages will become apparent hereinafter.

DESCRIPTION OF THE DRAWINGS

In the accompanying drawings which form part of the specification and wherein like numerals and letters refer to like parts wherever they occur—

FIG. 3 is a sectional view of the forming apparatus taken along line 3—3 of FIG. 1;

FIG. 4 is a sectional view of the forming apparatus taken along line 4—4 of FIG. 1; and FIG. 5 is a plan view of the emitter assembly taken along line 5—5 of FIG. 4.

DETAILED DESCRIPTION

Figure 2A:
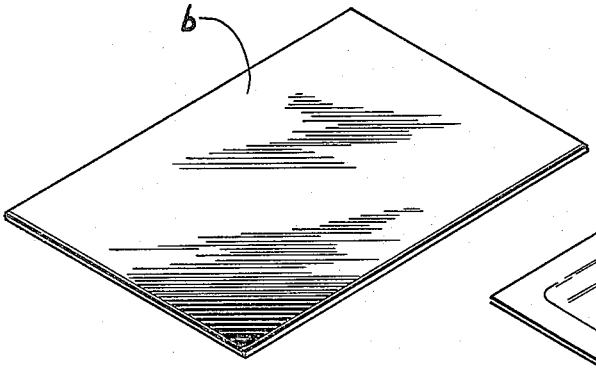
FIG. 2 illustrates a blank (FIG. 2*a*) from which a contoured part (FIG. 2*b*) is formed in the apparatus of FIG. 1.
Figure 2B:
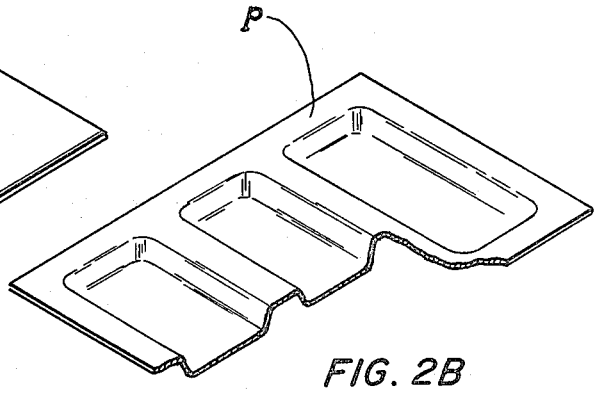

The process of the present invention transforms a flat sheet metal workpiece or blank b (FIG. 2A) into a formed part p (FIG. 2B) having various angles and contours that render it suitable for the particular purpose that it is to serve. The metal of the blank b should, when raised to a prescribed temperature, become superplastic, which means it loses much of its strength and will deform quite easily. Titanium and alloys of titanium have this characteristic, and so do certain alloys of aluminum. Titanium and its alloys are the primary metals with which this invention is concerned, and those metals become superplastic at about 1650° F. This discussion will therefore be confined primarily to the deformation of blanks b made from titanium.

Basically, the metal workpiece or blank b is placed opposite a surface having the contour which is desired for the part p, and is then heated with infrared lamps, the heating being within an inert atmosphere. Once the blank b reaches its superplastic temperature, the pressure of the inert atmosphere is increased to deform the blank b against the contoured surface, and hence the blank b assumes the contour of that surface. To create a pressure differential across the workpiece, a seal is established between the workpiece and the walls of a chamber that are above the contoured surface.

Figure 1:
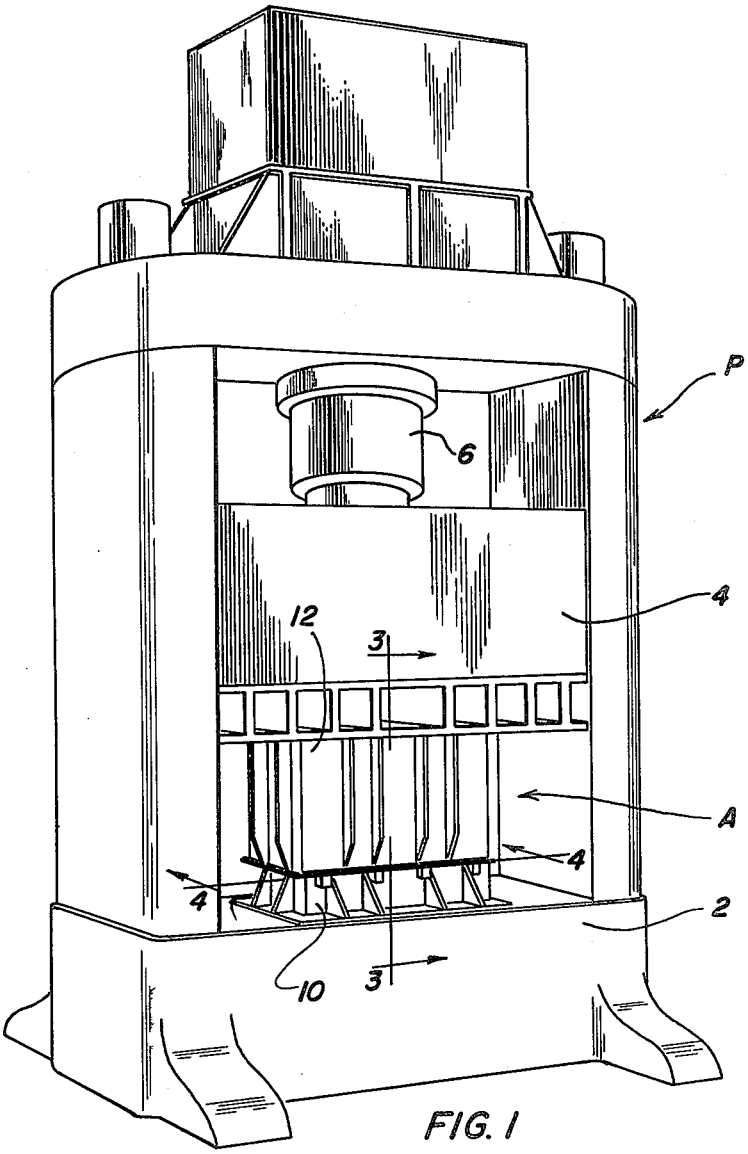
FIG. 1 is a perspective view of a press containing the apparatus of the present invention for superplastically forming metal.

The process is carried out on an apparatus A (FIG. 1) that fits into a press P having the usual fixed bed 2 and a head 4 that is attached to the press ram 6. The apparatus A includes a lower section 10, which is bolted firmly to the press bed 2, and an upper section 12, which is attached to the press head 4 and moves with it. When the head 4 is elevated, the upper section 12 is separated sufficiently from the lower section 10 to enable the blank b to be inserted between the two sections 10 and 12 and to further enable the formed part p to be removed from the space between the two sections 10 and 12. However, when the press ram 6 is extended with the blank b between the two sections 10 and 12, the blank b becomes clamped tightly between the sections 10 and 12.

The lower section 10 includes (FIGS. 3 & 4) a mounting plate 18 which rests on and is bolted firmly to the bed 2. Welded to the upper surface of the plate are upright end walls 20 and side walls 22 which are reinforced by gussets 23 and together form a rectangular cavity over the plate 18. This cavity is occupied by a ceramic insulation 24 having an upwardly opening cavity 26 and a flat surface 28 surrounding the cavity 26. The cavity 26 within the insulation 24 contains a forming tool 30 which has an upwardly presented surface 32, the contour of which corresponds to the contour that is to be imparted to the blank b which is of course the contour of the formed part p.

Along the upper surfaccs of the four walls 20 and 22 is a cooling tube 34 that surrounds the side of the ceramic insulation 24 slightly below its upper surface 28. The tube 34 contains a port 36 (FIG. 3) into which cooling water is directed into the hollow interior of the tube 34 and another port 36 through which the water is discharged. Thus, the tube 34 forms a cooling passage at the upper end of the lower section 10.

The cooling tube 34 is located immediately beneath a stripper plate 38 which likewise extends around the insulation 24, at least when it is depressed against the upper surface of the tube 34. Indeed, when the stripper plate 38 is against the tube 34, the upper surface of the plate 38 is generally flush with the upper surface 28 of the insulation 24. The plate 38, however, is urged upwardly away from the cooling tube 34 by spring units 40 which are mounted on the end and side walls 20 and 22 of the lower section 10, there being several spring units 40 located along each wall 20 and 22. Thus, the spring units 40 urge the stripper plate 38 to an elevated position slightly above the flat surface 28 of the insulation 24. The spring units 40 further limit the extent to which the plate 38 will rise. Thus, when the upper section 12 of the apparatus A is separated from the lower section 10, the spring units 40 hold the stripper plate 38 in its elevated position above the insulation 24.

Finally, one of the end walls 20 of the lower section 10 has a vent port 42 (FIG. 4) which is in communication with the cavity formed by the upwardly presented surface 32 in the forming tool 30.

The upper section 12 likewise includes (FIGS. 3 & 4) a mounting plate 48, and that plate is secured firmly to the head 4 at the end of the press ram 6. Welded to the plate 48 are end walls 50 and side walls 52 which are reinforced by gussets 53 and define a rectangular cavity or chamber 54 that opens downwardly toward the forming tool 30. Indeed, the end walls 50 and the side walls 52, align respectively with end walls 20 and side walls 22 of the lower section 10. The chamber 54 that is formed by the walls 50 and 52 is closed at its upper end by a cross wall or bulkhead 56 which is welded to each of the walls 50 and 52 generally intermediate their ends, the welds being such that they are air-tight. This enables the chamber 54 to be pressurized with an inert gas once it is sealed at the lower ends of the walls 50 and 52. Within the chamber 54, an insulation liner 58 is fitted against each end wall 50 and each side wall 52. The insulation liner 58 along one of the end walls 50 is partially cut away opposite to that end wall 52 to provide a relief, and the end wall 52 carries a port 60 (FIG. 3) which opens into the relief. The port 60 is connected to a source of inert gas, such as argon, that gas being under pressure so that the chamber 54, once it is sealed at its lower end, can be pressurized with the gas. Along the lower edges of the end and side walls 50 and 52, the upper section 12 is fitted with a cooling tube 62 which projects slightly below the insulation liners 58 and is substantially the same as the cooling tube 34 of the lower section 10. Indeed, the cooling tube 62 of the upper section 12 lies directly above and aligns with the cooling tube 34 of the lower section 10, but the two cooling tubes never contact each other because the stripper plate 38 is interposed between them, and likewise so is the blank b or part p. The cooling tube 62 also has inlet and outlet ports 64 (FIG. 3).

The sealed chamber 54 of the upper section 12 contains an infrared emitter assembly 68 (FIGS. 3–5) including a reflector 70 having a downwardly presented reflective surface that is spaced from, yet is parallel to the bulkhead 56. The emitter assembly 68 also includes a peripheral wall 72 that surrounds the reflector 70 and projects downwardly. The emitter assembly 68 is supported within the chamber on threaded rods 74 that extend through the bulkhead 56 such that the emitter assembly 68 may be lowered out of the chamber 54 for servicing. Even so the rods 74 are sealed to the bulkhead 56 during normal operation of the apparatus so the chamber 54 may be pressurized. Those sections of the peripheral wall 72 that are located along the end walls 50 of the upper section 12 are provided with circular apertures 76 (FIG. 3) that are arranged within a single row within each section of the wall 72. Moreover, each aperture 76 in one section of the wall 72 aligns with an aperture 76 in the opposite section of the wall 72 so that the apertures 76 are arranged in pairs within the peripheral wall 72. Both the reflector 70 and the peripheral wall 72 contain cooling passages 78 (FIG. 3) that are connected through ports to a source of cooling water, just as are the cooling tubes 34 and 62.

On the upper surface of the reflector 70 are electrical insulators 80 on which bus brackets 82 are mounted, and these brackets project laterally beyond those sections of the peripheral wall 72 that contain the apertures 76, and then downwardly so that their lower ends are located directly outwardly from the apertures 76. The bus brackets 82 are by means of small clips 84 (FIG. 3) attached to the ends of quartz infrared lamps 86 which are commercially available. In this regard, each lamp 86 is essentially a clear quartz glass tube, a resistance type heating element extended through the tube, and a terminal of some type at each end of the glass tube. The tube is somewhat larger than the space between the two sections of the peripheral wall 72 that contain the apertures 76, and is extended through a pair of apertures 76. Indeed, a different lamp 86 is extended through each pair of aligned apertures 76 in the peripheral wall 72 (FIGS. 3 & 5). When the lamps 86 are properly positioned, the terminals at their ends are located opposite to the downwardly extending portions of the bus brackets 82, to which those terminals are connected by the clips 84.

Each bus bracket 82 is connected by a lead 88 to its own electrical pass through gland 90 (FIGS. 3 & 4) which is mounted in and passes through the bulkhead 56, forming an air-tight seal with the bulkhead 56. The glands 90 are in turn attached to more leads 92 that extend through one of the end walls 50 to a source of electrical energy, the potential of which can be varied. The arrangement is such that the source of electrical energy places an electrical potential across the bus brackets 82 at opposite ends of the peripheral wall 72 so that an electrical current flows through the lamps 86 and causes them to emit infrared radiation. Some of this radiation is directed downwardly and some upwardly, the latter being reflected from the reflector 70 so that it too is directed downwardly.

The bulkhead 56 of the upper section 12 carries several sensing units 96 (FIGS. 3 & 4) which are designed to detect the temperature of the blank b and to translate that temperature into a signal which controls the power source in the sense that the power source varies the voltage supplied to the lamps 86 of the emitter assembly 68 to achieve a desired amount of radiation from the emitter assembly 68. The sensing units 96 are arranged in rows between the end walls 50 of the upper section 12. Each unit 96 includes an infrared optic sensor 98 that is bolted to the bulkhead 56 such that it "looks" downwardly, that is, senses the temperature below it. Actually, each optic sensor 98 looks through a tube 100, which also constitutes part of the sensor 96. The tube 100 passes through the bulkhead 56 and the reflector 70 perpendicular to the supporting surface 28 on the lower section 10. The lower ends of the tube 100 are slightly below the lamps 86 where they are presented directly over the blank when it is in the apparatus A. Thus, only infrared radiation that is reradiated from the blank b passes into the tubes 100, and since the amount of this radiation is proportional to the temperature of the blank b that is below the tubes 100, the optic sensors 98 at the upper ends of the tubes 100 in effect measure the temperature of the blank b. Actually, the sensors 98 produce an electrical signal in response to the radiation, and that signal controls the amount of electrical energy delivered to the emitter assembly 68. The infrared optic sensors 98 respond instantly to changes in the temperature of the blank b, and accordingly, it is possible to bring the blank b to a prescribed temperature and maintain it at that temperature while the blank b is deformed into the formed part p. The sensing units 96 are sealed themselves and are further bolted to the bulkhead 56 at air-tight seals. This permits the chamber 54 to be pressurized.

Actually, the quartz lamps 86 are arranged in zones, and each zone is controlled by a different sensor 98 at the zone. This insures that the portion of the blank b that is beneath the lamps 86 is heated uniformly.

While the optic sensors 98 are quite accurate and very responsive, they do not operate satisfactorily in a high temperature environment, that is above about 300° F. Being located above the bulkhead 56 and therefore outside of the chamber 54 in which the infrared emitter assemblies 68 are located, the sensors 98 are in a region of relatively low temperature. To ensure that the sensors 98 remain at a satisfactory operating temperature, air is circulated through the region in which they are located above the bulkhead 56. To this end, one of the end walls 50 of the upper section 12 contains a fitting 102 (FIG. 3) in which a nozzle 104 is installed. The nozzle 104 is directed into the space above the bulkhead 56 and the fitting 102 is partially open around the nozzle 104 so the nozzle 104 has an aspirating effect, that is, it draws outside air into the space above the bulkhead 56 when a jet of air issues from it. The nozzle 104 is connected to a source of pressurized air through a pressure regulator 106 that is mounted on the end wall 50 near the fitting 102.

OPERATION

Initially the apparatus A is in an open condition, that is, the upper section 12 is elevated above the lower section 10 so that the blank b can be inserted between the two sections 10 and 12. In short, the press ram 6 is retracted.

To prepare the apparatus A for operation, the temperature at which the metal of the blank b will become superplastic is determined and the control unit for the source that supplies the electrical energy to the lamps is set so that the lamps will emit enough energy to maintain the blank b at the superplastic temperature. In the case of titanium and its alloys, this temperature is about 1650° F. Also, cooling water is circulated through the cooling tube 34 at the upper end of the lower section 10 and likewise through the cooling tube 62 at the lower end of the upper section 12. More cooling water is circulated through the cooling passages 78 in the reflector 70 and peripheral wall 72 of the emitter assembly 68. Furthermore, the pressure regulator 104 is opened to deliver pressurized air to the nozzle 104 and that air issues from the nozzle 104 as a jet which has an aspirating effect in that it draws additional air into the space above the bulkhead 56 so that a constant stream of cool air is circulated past the optic sensors 98 of the sensing units 96. This insures that the sensors 98 remain below 300° F., their maximum operating temperature.

Also, the blank b must be prepared to effect a good seal with the upper section 12, but this is a relatively simple procedure involving nothing more than placing a sealant on the portion of its upper surface against which the cooling tube 62 bears when the upper section 12 is forced downwardly against the lower section 10. Gortex sealant, which is sold in the form of plastic tape, is suitable for this purpose.

The blank b is placed on the stripper plate 38 of the lower section 10 with the sealant presented upwardly such that it aligns with the cooling tube 62 of the upper section 12. Next, the press P is energized to extend its ram 6, and the ram 6 moves its press head 4 and the upper section 12 of the forming apparatus A downwardly. As the upper section 12 approaches the lower section 10, the cooling tube 62 on the upper section 12 contacts the Gortex seal on the blank b. Further advancement of the upper section 12 forces the blank b and stripper plate 38 downwardly. Eventually, the stripper plate 38 seats against the cooling tube 34 of the lower section 10, whereupon the stripper plate 38 and blank b are captured tightly between the cooling tubes 34 and 62 of the upper and lower sections 10 and 12, respectively. Actually, the blank b is clamped between the lower surface of the cooling tube 62 and the upper surface of the stripper plate 38, these surfaces thus serving as clamping surfaces. The force exerted by the ram 6 of the press P is maintained at a prescribed magnitude so as to effect an air-tight seal between the cooling tube 62 of the upper section 12 and the upper surface of the blank b. The seal is of course enhanced by the sealant which is interposed between the clamping surface of the cooling tube 62 and the blank b.

After the upper section 12 has closed onto the blank b and the lower section 10, the power source is activated with the lamps 86 of the emitter assembly 68 to energize those lamps. The lamps 86 produce infrared radiation which is directed toward the blank b both by the lamps 86 themselves and by the reflector 70 which is directly above the lamps 86. This infrared radiation is absorbed by the blank b and as a consequence, the temperature of the blank b rises. As the temperature approaches that at which the blank b becomes superplastic, the blank b begins to reradiate the infrared energy and this radiation, that is some of the radiation emitted from the blank b, passes through tubes 100 of the sensor units 96, beyond which it is cast upon the optic sensors 98. The sensors 98 in turn convert the radiation into an electrical signal which is proportional to the temperature of the blank b. This signal, which is a simple voltage, controls the power source such that the blank b upon reaching a prescribed temperature, which in the case of titanium should be 1650° F., is maintained at that temperature.

When the blank b reaches the prescribed temperature, more argon gas is admitted to the chamber 54 through the ports 60. Since the chamber 54 is now airtight, by reason of the seal established along the cooling tube 62, the pressure of the argon within the chamber 54 builds up and exerts a force on the blank b. Indeed, the force is sufficient to deform the superplastic metal of the blank b against the contoured surface 32 of the forming tool 30, so that the portion of the blank b which overlies the tool 30 acquires the configuration of the contoured surface 32. The pressure is maintained for approximately 30 minutes, whereupon the lamps 86 are de-energized and the pressure is released. While the lamps 86 heat the blank b, cooling water circulates through the cooling tubes 34 and 62 at the periphery of the blank b, maintaining this portion of the blank b, a relatively low temperature. After the blank b is forced against the contoured surface 32 of the tool 30, the lamps 86 of the emitter assembly 68 are de-energized, and the formed part p immediately cools by reason of the conduction of heat into the water circulating through the cooling tubes 34 and 62. Thereafter the ram 6 of the press p is retracted, and it withdraws the upper section 12 from the lower section 10. As the upper section 12 retracts, the spring units 40 urge the stripper plate 38 upwardly, causing it to lift the formed part p out of the forming tool 30.

Once the upper section 12 has reached its uppermost position, the formed part p is merely lifted from the lower section 10, and this may be done manually and without any protective clothing or other devices for the operator. In this regard, once the lamps 86 are de-energized, the emitter assembly 68 does not radiate enough energy to produce any discomfort. Furthermore, the part p, at least at its peripheral portion, never does reach a temperature which is high enough to burn the operator's hands, so that the part p can be lifted easily and without any discomfort.

The sensing units 96 detect the actual temperature of the blank b and not the temperature of surrounding components such as the forming tool 30 as is the case with thermal couples. They of a nccessity must be embedded in surrounding components. Furthermore, the sensors 98 of the units 96 respond much more quickly than thermal couples. As a consequence, the temperature of the blank b is determined with considerable precision and is maintained by the desired temperature with relatively little fluctuation.

The apparatus A and process may also be used to contemporaneously form and diffusion bond two sheets together, in which case one sheet is layed over the other and the two are joined together along their peripheries to form an envelope that has ports so that it can be pressurized. When placed in the apparatus, the upper sheet is confined by a plate to prevent it from deforming into the emitter. Although the plate absorbs radiant energy, it reradiates that energy to the upper sheet, which in turn reradiates it to the lower sheet, so that both sheets reach the superplastic temperature. When the envelope is pressurized, the lower sheet deforms against the tool while the upper sheet is confined by the plate. When the chamber is pressurized, the upper sheet is forced against the lower sheet, and by reason of the superplastic conditions the two sheets diffusion bond together in selected regions.

This invention is intended to cover all changes and modifications of the example of the invention herein chosen for purposes of the disclosure which do not constitute departures from the spirit and scope of the invention.

What is claimed is:

1. An apparatus for shaping a metal workpiece, the metal of which becomes superplastic at elevated temperatures, said apparatus comprising: a tool having a surface contoured to match the shape which is to be imparted to the workpiece; a tool clamping surface surrounding the tool; an enclosure forming a chamber that opens toward the contoured surface on the tool and having an enclosure clamping surface that is located opposite to and aligns with the clamping surface surrounding the tool, the enclosure being capable of holding within its chamber a gas at a higher than ambient pressure when the chamber is sealed along the enclosure clamping surface, the enclosure further being mounted with respect to the tool and tool clamping surface such that the distance between the tool clamping surface and the enclosure clamping surface may be varied to enable a workpiece to be inserted between the contoured surface of the tool and the chamber for the enclosure and thereafter clamped between the two clamping surfaces; cooling means located adjacent to at least one of the clamping surfaces for providing a channel through which a cooling fluid is circulated such that heat conducted from the workpiece through said one clamping surface is absorbed in the cooling fluid; an emitter located within the enclosure and being capable of directing toward the tool and a workpiece over the tool sufficient infrared radiation to elevate the temperature of the workpiece to the point that the workpiece becomes superplastic, so that when a pressurized gas is introduced into the chamber of the enclosure to elevate the pressure within the chamber, the workpiece is deformed against the contoured surface of the tool, whereby the workpiece acquires the configuration of the contoured surface; at least one tube extending into the enclosure and having one end presented toward the tool such that radiation from a workpiece over the tool will enter the tube, but not radiation emitted directly from the emitter, the tube having another end which is located outside of the chamber; and an optical infrared sensor at the opposite end of the tube for monitoring the temperature of the workpiece.

2. An apparatus according to claim 1 and further comprising means for circulating cooling air past the optic sensor.

3. An apparatus according to claim 1 wherein the enclosing means comprises walls that surround the emitter and a bulkhead connected to those walls and located behind the emitter so that the emitter is located between the bulkhead and tool.

4. An apparatus according to claim 1 wherein the emitter comprises a reflector that is presented toward the tool and a plurality of quartz infrared lamps in front of the reflector.

5. An apparatus according to claim 4 wherein said one end of the tube is presented at least as close to the tool as the quartz infrared lamps.

6. An apparatus according to claim 1 wherein the cooling means are located adjacent to both the tool clamping surface and the enclosure clamping surface.

7. An apparatus according to claim 1 and further comprising means mounted on the enclosure for circulating air at substantially ambient pressure past the optical infrared sensor, so that the sensor operates at a temperature substantially below the temperature within the chamber.

8. An apparatus for shaping a metal workpiece, the metal of which becomes superplastic at elevated temperatures, said apparatus comprising: a first section having a cooling duct that surrounds an area; a forming tool located in the area surrounded by the cooling duct and having an exposed surface which is contoured to match the shape which is to be imparted to the workpiece; a second section having walls that enclose a chamber which opens toward the contoured surface of the tool and a cooling duct on some of the walls, with that duct being located opposite to and aligning with the cooling duct of the first section; means for bringing the sections from an open position in which they are spaced apart, wherein the workpiece may be inserted between the sections, to a closed position in which the workpiece is clamped between the cooling ducts of the two sections and is sealed against the cooling duct of the second section; quartz lamps carried by the second section within the chamber of that section and being presented toward the forming tool; a reflector located within the chamber for reflecting radiation emitted from the quartz lamps toward the tool and a workpiece over the tool; a sensing tube carried by the second section and having one end located outside of the chamber, the tube extending through a wall of the first section and past the reflector, and having its opposite end presented toward the forming tool in a region where direct radiation from the quartz lamps does no enter the tube; an optical sensor located on the end of the tube that is outside of the chamber, such that the optical sensor will receive radiation radiated from a workpiece over the tool; means for pressurizing the chamber when it is in its closed position; and means for circulating a cooling medium past the optical sensor to maintain it at a relatively low temperature.

9. A process for imparting a desired configuration to a workpiece, the workpiece being formed from a metal which when elevated to a prescribed temperature becomes superplastic, said method comprising: placing the workpiece over a tool having a contoured surface, the configuration of which corresponds to the configuration desired for the workpiece; bringing and sealing the walls of an enclosure against the surface of the workpiece that is presented away from the contoured surface of the tool so as to isolate a chamber opposite the portion of the workpiece that is directly over the contoured surface of the tool, with the workpiece forming a wall of the chamber; circulating a cooling fluid near the region of the workpiece that is sealed to the walls of the enclosure such that heat will be conducted away from that region of the workpiece and absorbed in the cooling fluid; generating sufficient infrared radiation within the chamber to elevate the temperature of the workpiece to the extent that the workpiece becomes superplastic; pressurizing the chamber while the workpiece is superplastic, whereby the workpiece deforms against the contoured surface of the forming tool and acquires the configuration of the contoured surface; and optically ascertaining the temperature of the workpiece from a location remote from the chamber by observing the workpiece with an optical sensor through a tube extended into the chamber to at least the location where the infrared radiation is generated such that the radiation so generated does not directly enter the tube.

10. The process according to claim 9 and further comprising controlling the energy directed to the emitter in response to the temperatures that are sensed.

11. The process according to claim 9 wherein the temperature of the workpiece is sensed with at least one infrared optic sensor.

12. The process according to claim 11 and further comprising circulating air past the optic sensors to remove heat from them.

13. The process according to claim 9 wherein the enclosure has a clamping surface along its walls, and the walls of the enclosure are sealed to the workpiece at the clamping surface; wherein another clamping surface surrounds the tool; wherein the workpiece when it is sealed against the walls of the enclosure and is over the contoured surface of the tool is clamped between the two clamping surfaces; and wherein the cooling fluid is circulated adjacent at least one of the clamping surfaces.

14. The process according to claim 9 wherein the cooling fluid is circulated adjacent to both of the clamping surfaces.

15. The process according to claim 14 wherein the tool remains fixed in position with respect to the enclosure as the chamber is pressurized and as the workpiece is deformed against the tool.

16. The process according to claim 9 wherein the step of generating infrared radiation comprises energizing quartz lamps that are within the chamber of the enclosure.

17. The process according to claim 16 wherein the step of generating infrared radiation further comprises reflecting to the workpiece the infrared radiation derived from the quartz lamps.

* * * * *